US007153102B2

(12) United States Patent
Stone

(10) Patent No.: US 7,153,102 B2
(45) Date of Patent: Dec. 26, 2006

(54) BLADED DISK FIXING UNDERCUT

(75) Inventor: Paul Stone, Guelph (CA)

(73) Assignee: Pratt & Whitney Canada Corp., Longueuil (CA)

( * ) Notice: Subject to any disclaimer, the term of this patent is extended or adjusted under 35 U.S.C. 154(b) by 76 days.

(21) Appl. No.: 10/845,189

(22) Filed: May 14, 2004

(65) Prior Publication Data

US 2005/0254952 A1 Nov. 17, 2005

(51) Int. Cl.
*F01D 5/30* (2006.01)
*F01D 5/32* (2006.01)

(52) U.S. Cl. ..... 416/219 R; 416/220 R; 416/244 R

(58) Field of Classification Search ..... 416/219 R, 416/220 R, 248, 244 R, 244 A, 198 A, 204 A
See application file for complete search history.

(56) References Cited

U.S. PATENT DOCUMENTS 3,689,177 A * 9/1972 Klassen ..... 416/198 R
4,033,705 A * 7/1977 Luebering ..... 416/220 R
5,067,877 A * 11/1991 Youssef ..... 416/220 R
5,112,193 A 5/1992 Greer et al.
5,160,242 A 11/1992 Brown
5,286,168 A 2/1994 Smith
5,567,116 A 10/1996 Bourcier
5,622,475 A * 4/1997 Hayner et al. ..... 416/220 R
5,624,233 A * 4/1997 King et al. ..... 416/219 R
5,725,354 A 3/1998 Wadia et al.
5,947,687 A 9/1999 Mori et al.
5,954,477 A * 9/1999 Balsdon ..... 416/95
6,019,580 A 2/2000 Barr et al.
6,033,185 A 3/2000 Lammas et al.
6,390,775 B1 5/2002 Paz
6,481,967 B1 11/2002 Tomita et al.
6,520,742 B1 2/2003 Forrester et al.
6,764,282 B1 * 7/2004 Suciu et al. ..... 416/220 R

* cited by examiner

*Primary Examiner*—Igor Kershteyn
(74) *Attorney, Agent, or Firm*—Ogilvy Renault LLP

(57) ABSTRACT

An undercut is provided in a gas turbine engine disk to smooth out an uneven axial distribution of radial stress in the disk. The undercut is defined radially inwardly of the blade attachment slots provided at the periphery of the disk.

14 Claims, 2 Drawing Sheets

BLADED DISK FIXING UNDERCUT

BACKGROUND OF THE INVENTION

1. Field of the Invention

The present invention relates to gas turbine engines and, more particularly, to rotor disks of such engines.

2. Background Art

Fan rotors can be manufactured integrally or as an assembly of blades around a disk. In the case where the rotor is assembled, the fixation between each blade and the disk has to provide retention against extremely high radial loads. This in turn causes high radial stress in the disk retaining the blades.

In the case of "swept" fans, the blades are asymmetric with respect to their redial axis. A significant portion of the weight of these blades is cantilevered over the front portion of the fixation, which causes an uneven axial distribution of the radial load on the fixation and disk. This load distribution causes high local radial stress in the front of the disk and high contact forces between the blade and the front of the disk.

Although a number of solutions have been provided to even axial distribution of stress in blades, such as grooves in blade platforms to alleviate thermal and/or mechanical stresses, these solutions do not address the problem of high local radial stress in the disk supporting the blades.

Accordingly, there is a need for a disk for a gas turbine engine fan having a smoother axial distribution of radial stress.

SUMMARY OF INVENTION

It is therefore an aim of the present invention to provide an improved rotor disk for a gas turbine engine.

It is also an aim of the present invention to provide a method for smoothing an axial distribution of radial stress in a rotor disk.

Therefore, in accordance with a general aspect of the present invention, there is provided a gas turbine engine rotor disk comprising a disk body having a plurality of blade attachment slots circumferentially distributed about a periphery thereof, and wherein an undercut is provided radially inwardly of said blade attachment slots.

In accordance with a further general aspect of the present invention, there is provided a gas turbine engine rotor comprising a plurality of blades, each of said blades having a root received in a corresponding blade attachment slot defined in a disk adapted to be mounted for rotation about an axis, and wherein an axial distribution of radial stress in the disk is smoothed by providing an undercut in the disk radially inwardly of the blade attachment slots.

In accordance with a still further general aspect of the present invention, there is provided a method to smooth out an uneven axial distribution of radial stress in a gas turbine engine rotor disk having a plurality of blade attachment slots in which are retained a corresponding number of blades, the method comprising the step of: providing an undercut radially inwardly of said plurality of blade attachment slots.

BRIEF DESCRIPTION OF THE DRAWINGS

Reference will now be made to the accompanying drawings, showing by way of illustration a preferred embodiment of the present invention and in which.

DESCRIPTION OF THE PREFERRED EMBODIMENTS

Figure 1:
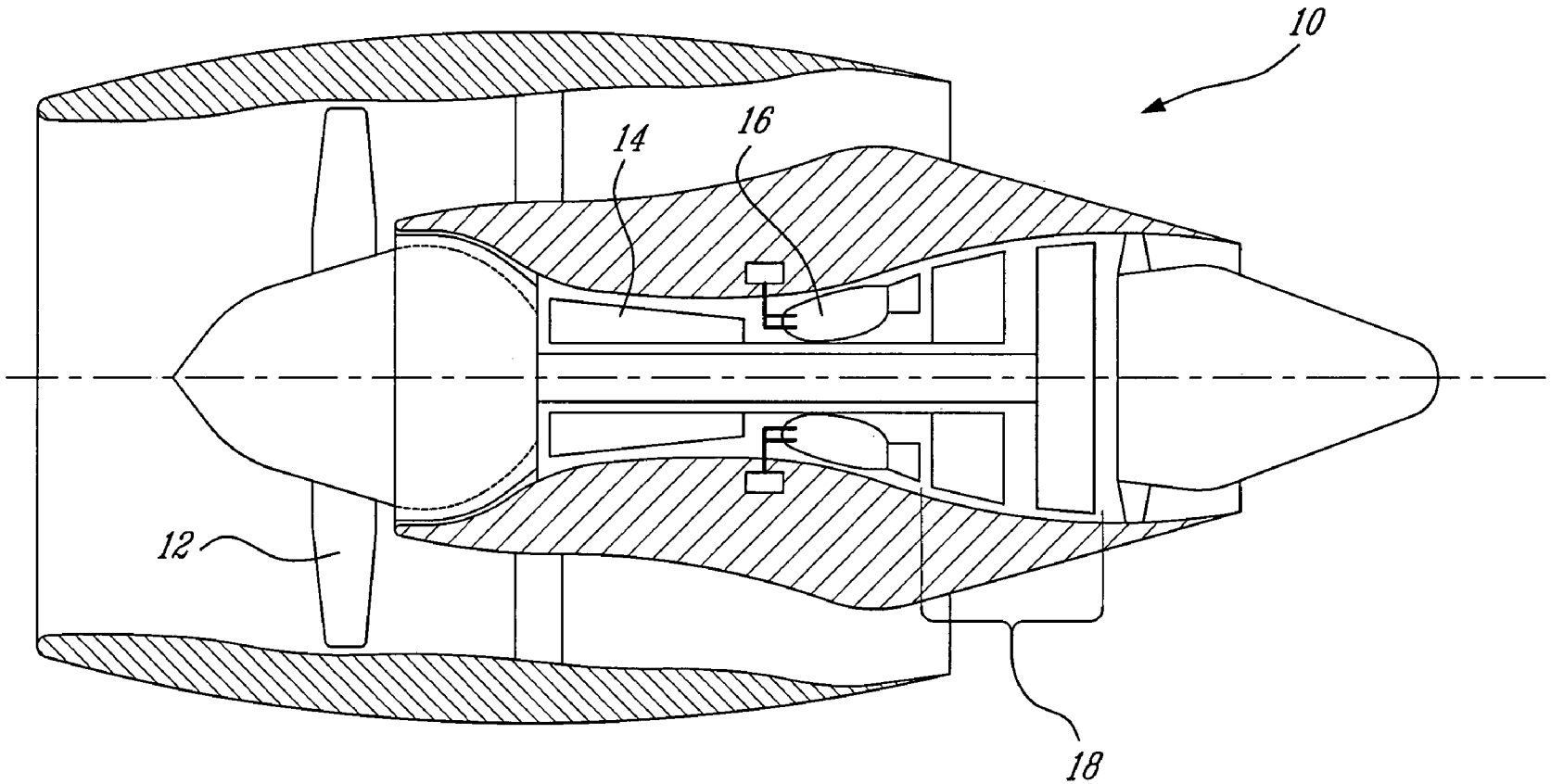
FIG. 1 is a side view of a gas turbine engine, in partial cross-section.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
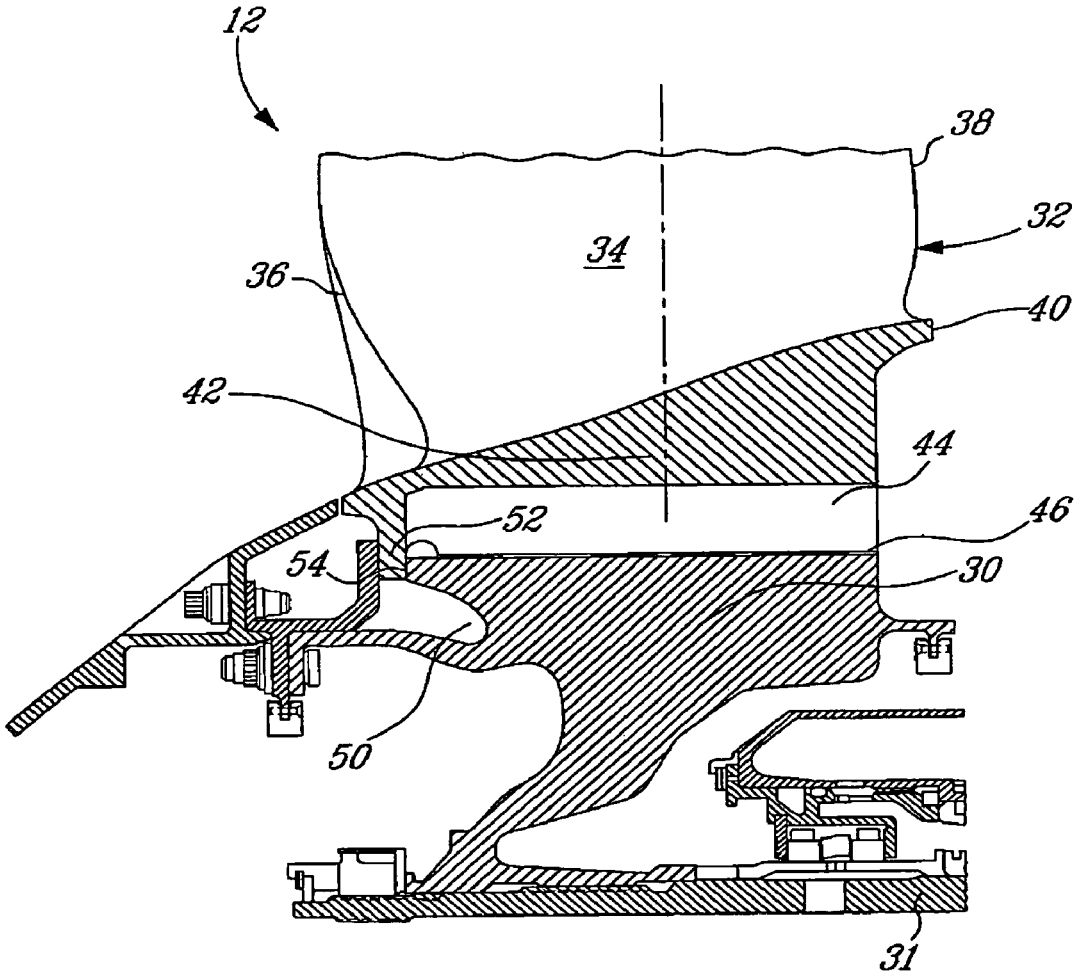
FIG. 2 is a partial side view of a fan, in cross-section, showing a disk according to a preferred embodiment of the present invention.

Referring to FIG. 2, part of the fan 12, which is a "swept" fan, is illustrated. Although the present invention applies advantageously to such fans, it is to be understood is can also be used with other types of radial fans, as well as other types of rotating equipment having a disk requiring a smoother axial distribution of radial stress including, but not limited to, compressor and turbine rotors.

The fan 12 includes a disk 30 mounted on a rotating shaft 31 and supporting a plurality of blades 32 which are asymmetric with respect to their radial axis. Each blade 32 comprises an airfoil portion 34 including a leading edge 36 in the front and a trailing edge 38 in the back. The airfoil portion 34 extends radially outwardly from a platform 40. A blade root 42 extends from the platform 40, opposite the airfoil portion 34, such as to connect the blade 32 to the disk 10. The blade root 42 includes an axially extending dovetail 44, which is designed to engage a corresponding dovetail groove 46 in the disk 30. Other types of attachments can replace the dovetail 44 and dovetail groove 46, such as a bottom root profile commonly known as "fir tree" engaging a similarly shaped blade attachment slot in the disk 10. The airfoil section 34, platform 40 and root 42 are preferably integral with one another.

As stated above, the asymmetry of the blade 32 cause a significant portion of the blade weight to be cantilevered over the front portion of the dovetail 44. This creates an uneven axial distribution of the radial load on the dovetail 44 and disk 30. Such a load distribution produces unacceptably high local radial stress in the front of the disk 30 and contact forces between the dovetail 44 and the front of the dovetail groove 46.

According to an embodiment of the present invention, the axial distribution of the radial stresses in the disk 30 is smoothed by way of a continuous annular undercut 50 provided in the front of the disk 30, radially inwardly of the dovetail groove 46. The undercut 50 is preferably rounded and generally slightly curved toward the rotating shaft 31.

Although a number of different geometries are possible for the undercut 50, the geometry must be carefully selected in order to produce a favorable change in the load path of the disk 30. For example, in the case of a "swept" fan, a simple straight undercut will lower the stress at the leading edge of the disk but cause a sharp peak further back, which is undesirable. By contrast, the undercut 50 having the geometry shown in FIG. 2 will produce a radial stress having a maximum generally constant value along a significant middle portion of the disk 30, with a generally progressively lower value toward both the leading and trailing edge of the disk. A preferred way of determining the appropriate undercut geometry is through 3D finite element analysis according to methods well known in the art.

The undercut 50 thus eliminates the unacceptably high local radial stress in the front of the disk 30 and contact forces between the dovetail 44 and the front of the dovetail groove 46 by evening the axial distribution of the radial stresses in the disk 30.

The undercut 50, among other things, allows for a simple way to balance the axial distribution of radial stress in a disk of a "swept" fan, as well as in other types of disks requiring similar balancing of the axial distribution of radial stress. As clearly shown in FIG. 2, the undercut 50 and the grooves 46 define therebetween a front peripheral rim 54. The peripheral rim 54 provides an arresting surface for the blades 32. Each blade 32 has a front overhang 52 adapted to be abutted against the rim 54 to limit axial rearward movement of the bade 32 in the grooves 46.

The embodiments of the invention described above are intended to be exemplary. Those skilled in the art will therefore appreciate that the foregoing description is illustrative only, and that various alternatives and modifications can be devised without departing from the spirit of the present invention. Accordingly, the present is intended to embrace all such alternatives, modifications and variances which fall within the scope of the appended claims.

The invention claimed is:

1. A gas turbine engine rotor disk comprising a disk body having a plurality of blade attachment slots circumferentially distributed about a periphery thereof, and wherein an undercut is provided radially inwardly of said blade attachment slots, wherein said undercut is bounded by radially inner and outer walls which converge towards a rotational axis of the disk in a depthwise direction of the undercut.

2. A gas turbine engine rotor disk as defined in claim 1, wherein said undercut has an annular configuration.

3. A gas turbine engine rotor disk as defined in claim 1, wherein said undercut curves in an axial direction from the front of the disk towards the rotational axis thereof.

4. A gas turbine engine rotor disk as defined in claim 3, wherein said undercut has a generally rounded shape.

5. A gas turbine engine rotor comprising a plurality of blades, each of said blades having a root received in a corresponding blade attachment slot defined in a disk adapted to be mounted for rotation about an axis, and wherein an axial distribution of radial stress in the disk is smoothed by providing an undercut in the disk radially inwardly of the blade attachment slots, the undercut and the blade attachment slots defining therebetween a rim, and wherein each of said blades has an overhang abutted against the rim, the overhang limiting axial rearward insertion of the blades in the blade attachment slots.

6. A gas turbine engine rotor as defined in claim 5, wherein said undercut is annular.

7. A gas turbine engine rotor as defined in claim 5, wherein said undercut curves in an axial direction from the front of the disk towards a rotational axis thereof.

8. A gas turbine engine rotor as defined in claim 6, wherein said undercut has a generally rounded shape.

9. A gas turbine engine rotor as defined in claim 5, wherein said rotor is a swept fan, and wherein said undercut is defined in a front side of the disk.

10. A gas turbine engine rotor as defined in claim 5, wherein said blades are asymmetric with respect to respective radial axes thereof so that a significant portion of the weight of said blades is cantillevered over a front portion of the disk, thereby causing an uneven axial distribution of the radial load along the roots and corresponding blade attachment slots, and wherein said undercut is defined in the front portion of the disk.

11. A method to smooth out an uneven axial distribution of radial stress in a gas turbine engine rotor disk having a plurality of blade attachment slots in which are retained a corresponding number of blades, the method comprising: determining an axial location of the disk which is subject to high radial stress and defining the undercut at said axial location, and providing an undercut radially inwardly of said plurality of blade attachment slots, said undercut being bounded by radially inner and outer walls which converge towards a rotational axis of the disk in a depthwise direction of the undercut.

12. A method as defined in claim 11, wherein the undercut is annular.

13. A method as defined in claim 12, wherein the annular undercut curves radially inwardly from the front of the disk.

14. A method as defined in claim 11, wherein said blades are asymmetric with respect to respective radial axes thereof so that a significant portion of the weight of said blades is cantilevered over a front portion of the disk, thereby causing an uneven axial distribution of the radial load along the blade attachment slots.

* * * * *